US005701944A

United States Patent [19]

Young

[11] Patent Number: 5,701,944

[45] Date of Patent: Dec. 30, 1997

[54] DIE CASTING MACHINE AND METHOD

[75] Inventor: Robert W. Young, Temperance, Mich.

[73] Assignee: Doehler-Jarvis Technologies, Inc., Toledo, Ohio

[21] Appl. No.: 560,340

[22] Filed: Nov. 17, 1995

[51] Int. Cl.[6] ..... B22D 17/12; B22D 17/30

[52] U.S. Cl. ..... 164/113; 164/312

[58] Field of Search ..... 164/113, 312

[56] References Cited

U.S. PATENT DOCUMENTS

| | | | |
|---|---|---|---|
| Re. 32,048 | 12/1985 | Prince . | |
| 3,734,673 | 5/1973 | Paterson et al. | 425/450 |
| 3,826,302 | 7/1974 | Wunder | 164/312 |
| 3,866,666 | 2/1975 | Wunder | 164/327 |
| 4,049,040 | 9/1977 | Lynch | 164/120 |
| 4,460,324 | 7/1984 | Van Appledorn | 425/166 |
| 4,466,477 | 8/1984 | Alofs . | |
| 4,505,317 | 3/1985 | Prince | 164/153 |
| 4,548,544 | 10/1985 | Van Appledorn | 414/751 |
| 4,592,405 | 6/1986 | Allen | 164/120 |
| 4,655,274 | 4/1987 | Dannoura | 164/341 |
| 4,716,952 | 1/1988 | Hegal et al. . | |
| 4,741,379 | 5/1988 | Dannoura | 164/312 |
| 4,817,700 | 4/1989 | Milov et al. | 164/259 |
| 4,986,334 | 1/1991 | Bai | 164/312 |
| 4,986,335 | 1/1991 | Koch | 164/312 |
| 5,207,264 | 5/1993 | You | 164/312 |
| 5,234,045 | 8/1993 | Cisko | 164/97 |
| 5,284,201 | 2/1994 | Hegel et al. | 164/312 |
| 5,320,157 | 6/1994 | Siak et al. | 164/12 |
| 5,355,933 | 10/1994 | Voss | 164/120 |

FOREIGN PATENT DOCUMENTS

| | | | |
|---|---|---|---|
| 64-34555 | 2/1989 | Japan | 164/312 |

*Primary Examiner*—J. Reed Batten, Jr.

*Attorney, Agent, or Firm*—Emch, Schaffer, Schaub & Porcello Co., L.P.A.

[57] ABSTRACT

The machine includes a carriage assembly supporting a shot sleeve and shot cylinder at a fixed angle relative to vertical. The sleeve follows a first straight line path from a remote position to an intermediate position aligned with an aperture of the die casting die and a second path to a position communicating with the aperture. Docking cylinders lift the shot cylinder, sleeve and a docking plate to a position at which the docking plate is aligned with locking cylinders and to bring the sleeve into engagement with the die aperture. Actuation of the locking cylinders moves the docking plate into engagement with a sleeve frame supporting the shot cylinder which is thereafter actuated to eject molten metal from the sleeve engaged to the die aperture.

41 Claims, 15 Drawing Sheets

DIE CASTING MACHINE AND METHOD

BACKGROUND OF THE INVENTION

The present invention relates to a die casting machine in which molten aluminum is injected in a generally upwardly direction into a cavity defined by closed dies. Prior art patents disclose die casting machines of various types. For example, U.S. Pat. Nos. 4,655,274 and 4,741,379 disclose a horizontal mold clamping and vertical injection type die cast machine in which a vertical casting unit is provided with a pivotally mounted shot cylinder and sleeve for delivery of molten metal from a receiving station to a position for injecting it into the closed dies. The shot cylinder and sleeve unit is pivoted in a first direction at which the delivery sleeve has its upper receiving end positioned away from the dies in order to receive the molten metal at the receiving station and is thereafter pivoted to a position beneath the dies and lifted into engagement therewith preparatory to injecting molten aluminum therein. Other patents showing die casting machines in which molten aluminum is injected in a generally upwardly direction into a cavity defined by closed dies are U.S. Pat. Nos. 4,986,334 and 4,986,335 assigned to the assignee of the present invention and U.S. Pat. No. 5,284,201. Each of the die casting machines disclosed in such prior art patents utilize the feature of the sleeve being mounted for pivotal movement from a position intended to receive the molten metal to a second position ready for injecting the molten metal into the closed dies. Such pivotal movement of the Sleeve permits the utilization of a bottom slide adjacent the docking block of the type described in U.S. Pat. Nos. 4,986,334 and 4,986,335.

SUMMARY OF THE INVENTION

The present invention is directed to a die casting machine having a design in which the sleeve and the shot cylinder utilized therewith for injecting molten aluminum from such sleeve into the closed dies are disposed at a fixed angle relative to vertical and remain disposed at such angle throughout the operation (1) from the step of receiving molten aluminum at the receiving station, (2) during movement of the sleeve and shot cylinder from the receiving station to the injection station and (3) throughout the operation of engaging the dies and injecting the molten aluminum into the closed dies. One advantage of the die casting machine of the present invention includes the fact that the fixed angular position of the shot sleeve and shot cylinder provides for easier adjustment and a higher pour height position than is possible with the prior art pivotally mounted shot cylinder and sleeve.

Furthermore, under the design of the present invention, the shot cylinder, sleeve and the associated carrier assembly are mounted in a manner which results in movement of the shot cylinder toward the dies along with the sleeve when it is moved toward such dies to the docking position. This is in contrast to the prior art die casting machines set forth in the above prior art in which the shot cylinder remains in a fixed position when the sleeve is moved axially toward the dies to the docking and locking positions. As a result, the shot cylinder of the machine of the present invention is permitted to have a much shorter stroke than the stroke of the shot cylinder of such prior art machines. Such shorter stroke results in a significant reduction in hydraulic requirement, on the order of 20%, for the shot cylinder of the machine of the present invention as compared to such prior art machines.

Additionally, the die casting machine of the present invention utilizes separate cylinders for (1) docking of the sleeve with the docking block of the dies and (2) locking the shot cylinder in place prior to the step of injecting the molten metal into the cavity defined by the dies in order to support the shot cylinder against the forces urging its housing away from the dies upon initiation of the injection step moving the piston, shot arm and tip toward the dies. The utilization of separate docking and locking cylinders saves a substantial amount of hydraulic volume over that required with prior art machines which utilized a single set of cylinders for both docking and locking.

The utilization of separate cylinders for docking and locking permits a structural design which allows the mechanism to be, in effect, "close coupled" such that the loads, particularly the extremely high load generated by the shot cylinder and the resultant opposing forces resisted by the locking cylinders, may be carried through the frame structure. The advantage of this is in permitting the utilization of smaller structural members than would otherwise be required. Thus, in the machines disclosed in U.S. Pat. Nos. 4,655,274 and 4,741,379 the shot cylinder remains in a fixed position during the docking stroke and is required to be supported on much larger structural members than are required to support the shot assembly of the machine of the present invention. Additionally, as previously discussed, such prior art machines require a significantly longer stroke for the shot cylinder to eject the molten aluminum from the sleeve and inject it into the closed dies thereby requiring a greater hydraulic requirement than is required for the shot cylinder utilizing a shorter stroke. In the machine as described in the present invention, the actuation of the docking cylinders to move the sleeve into docking position with respect to the dies carries with it the shot cylinder thereby bringing such shot cylinder closer to the dies and therefore requiring a shorter shot cylinder stroke than is required in a machine of the type set forth in U.S. Pat. Nos. 4,655,274 and 4,741,379.

Accordingly, it is an object of the present invention to provide an efficient and reliable vertical shot die casting machine having superior characteristics to those of the prior art.

Additionally, it is an object of the present invention to provide a new and improved method of die casting.

DESCRIPTION OF THE INVENTION

Figure 12:
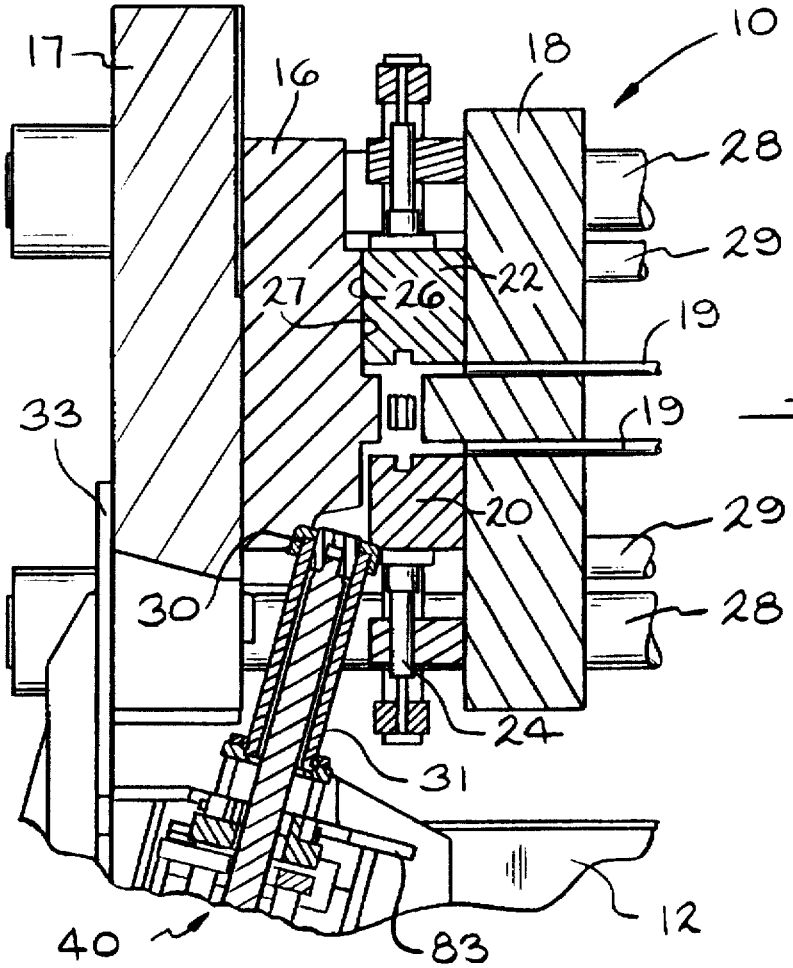
FIG. 12 is a view with the parts in the operating position of FIG. 11 but showing the closed dies.
Figure 13:
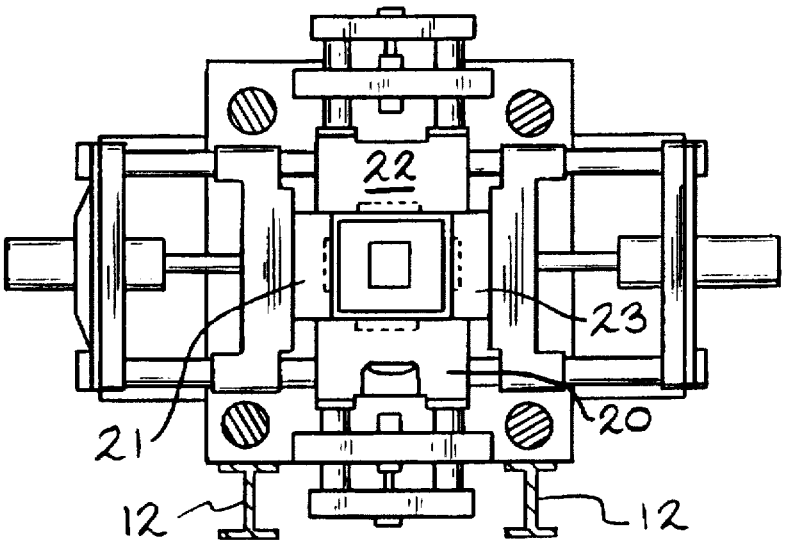
FIG. 13 is an elevation view of the die casting machine as viewed looking toward the moveable die.

A general orientation of the shot sleeve and related mechanism for injecting molten aluminum into the dies may be had by reference to FIGS. 12 and 13 where there is shown the die portion of a die casting machine 10 mounted on a base 12 over a pit. The die casting machine 10 comprises a stationary die 16 mounted on a stationary platen 17 and a moveable die 18 which allows for a bottom slide 20 and may contain other slides, for example slides such as the ones identified by the numerals 21, 22 and 23 (see FIG. 13). The bottom slide 20 is vertically movable by means of hydraulic cylinder 24 and the other slides by similar cylinders. As may be seen in FIG. 12, below the dies 16 and 18 is mounted a reciprocating molten metal injector or shot assembly 40 a portion of which extends into the pit. The moveable die 18 engages the stationary die 16 at their parting surfaces 26 and 27, respectively. The moveable die 18 is slideable along rail rods 28 by the action of piston rods 29 threadedly anchored to a moveable platen (not shown). A pair of ejector pins 19 extend through the movable die 18 to eject a newly cast part from the die cavity.

Mounted in the lower portion of the stationary die 16 at the parting surface 27 is a docking block 30 into which the shot sleeve 31 of the shot assembly 40 extends for connecting the sleeve 31 with the closed dies 16 and 18 for injecting molten metal into the cavity defined thereby.

Referring now to FIGS. 1 through 11, the shot assembly 40 is mounted such that the shot sleeve 31 extends along an axis A disposed at an angle X with respect to vertical and, as may be seen in FIGS. 5 through 7, 11 and 12, remains at such angle throughout the entire die casting operation. The purpose of disposing the shot sleeve 31 at an angle with respect to vertical is to avoid interference with the hydraulic cylinder 24 moving the bottom slide. Accordingly, such angle X could be as small as 10° provided the size of the cylinder 24 and related support structure was such as to avoid interference with the sleeve. Although an angle X of 15° is preferred, it could be significantly greater but not so great as to permit molten aluminum to spill from the sleeve prior to engaging the docking block 30.

Figure 1:
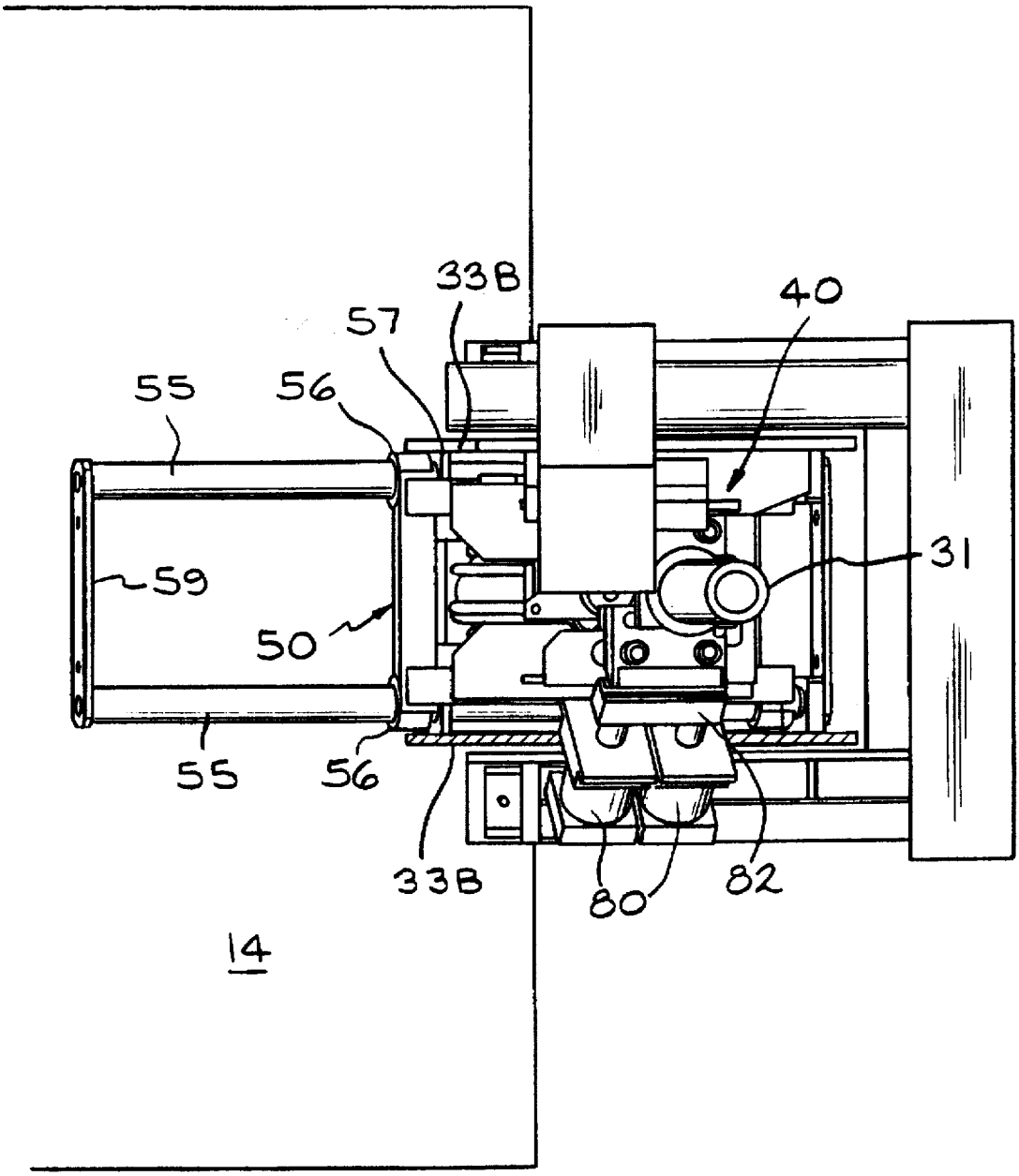
FIG. 1 is a top plan view of that portion of the die casting machine of the present invention below the platens and dies.
Figure 2:
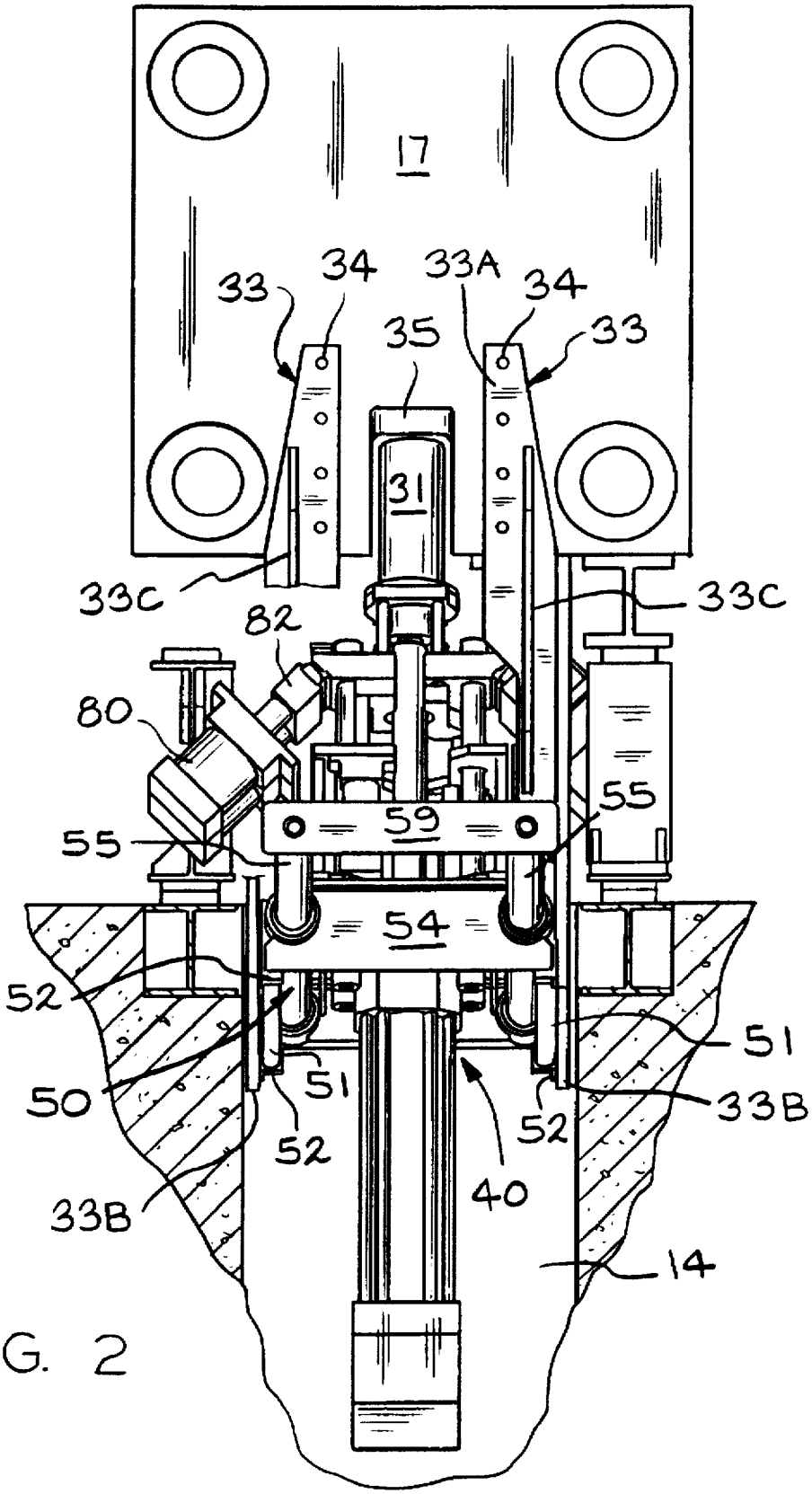
FIG. 2 is an elevational view of the die casting machine of the present invention.
Figure 3:
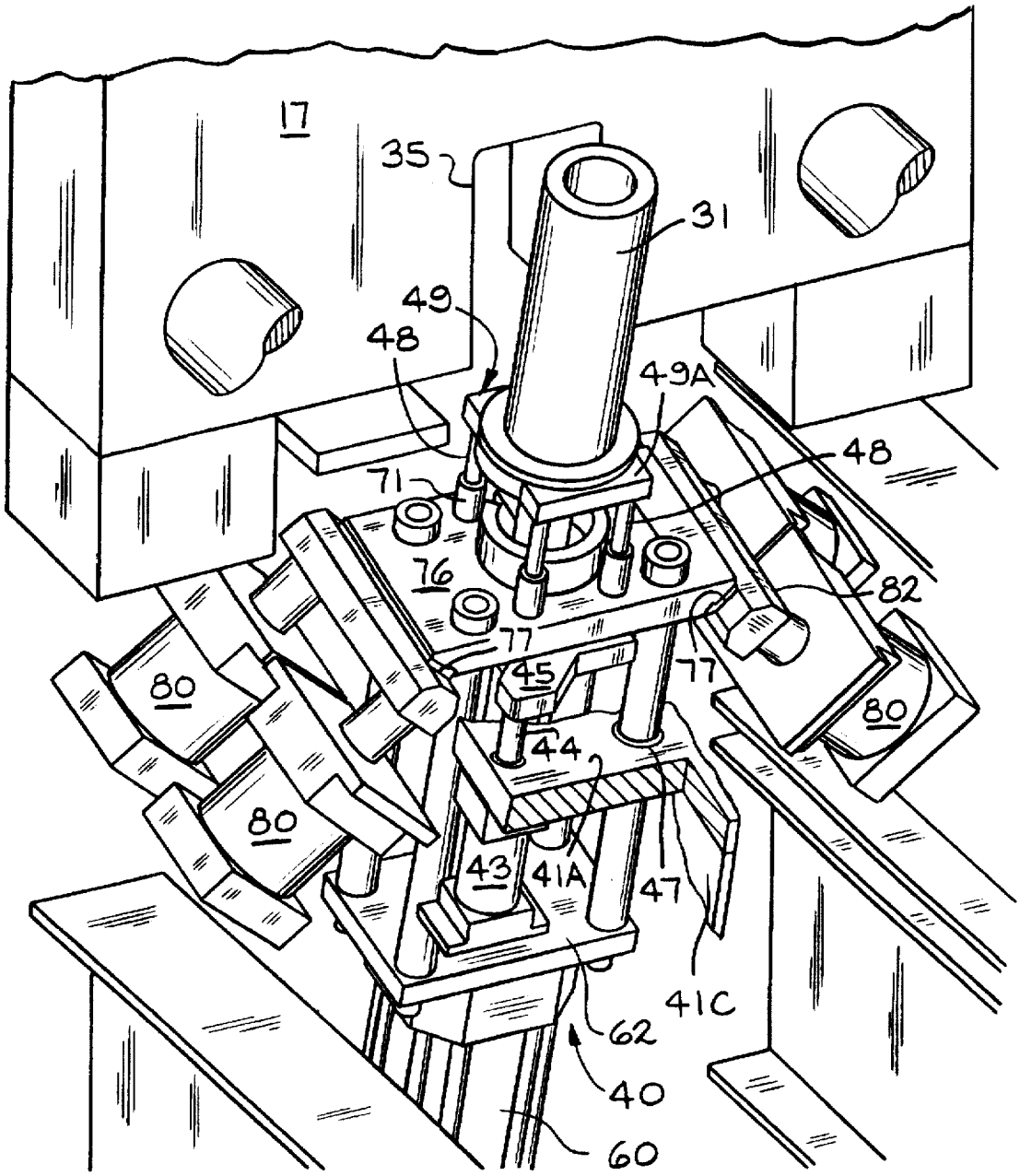
FIG. 3 is a fragmentary perspective view of the die casting machine of the present invention showing specifically the shot cylinder and sleeve, docking cylinders and locking cylinders and related support structure.
Figure 4:
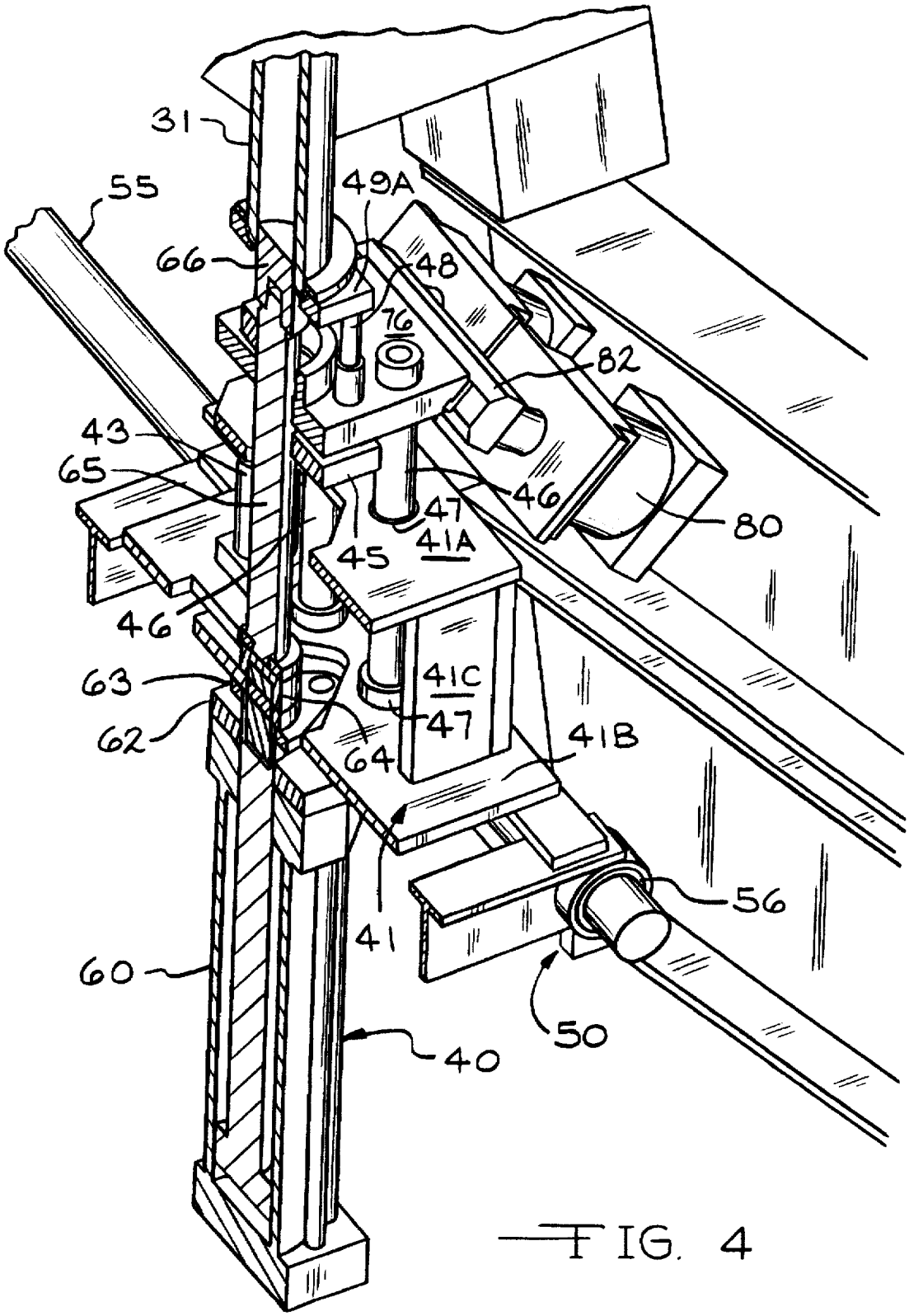
FIG. 4 is a fragmentary perspective view similar to FIG. 3 but showing a section through the shot sleeve and shot cylinder.

Except for four hydraulic locking cylinders to be hereinafter described, the shot assembly 40 is supported on a pair of structural members 33 fastened by bolts 34 to the reverse side of the path of movement of the stationary platen 17 from the stationary die 16. As can be seen in FIG. 2, structural members 33 include a pair of uprights 33A bolted to the stationary platen 17 in spaced apart relationship on opposite sides of the shot sleeve 31. The left hand one of the structural members 33 is broken away in order to permit a view of other components of the shot assembly 40. As can also be seen in FIGS. 2, 3, 5 et al. the stationary platen 17 is provided with a central cut-out 35 in order to provide an opening through which the shot sleeve 31 moves as it is reciprocated from the shot receiving position outside of platen 17 (FIG. 5) to the opposing position on the die side of the platen 17. When positioned on the die side of platen 17, with the sleeve 31 in angular alignment with the docking block 30, the shot assembly is ready for movement of the shot sleeve 31 along a straight line path to the docking position and the injection of the molten aluminum into the closed dies.

Each of the structural members 33 also includes a plate 33B welded or otherwise suitably affixed to the uprights of 33A and a reinforcing web 33C extending from each such upright.

Figure 5:
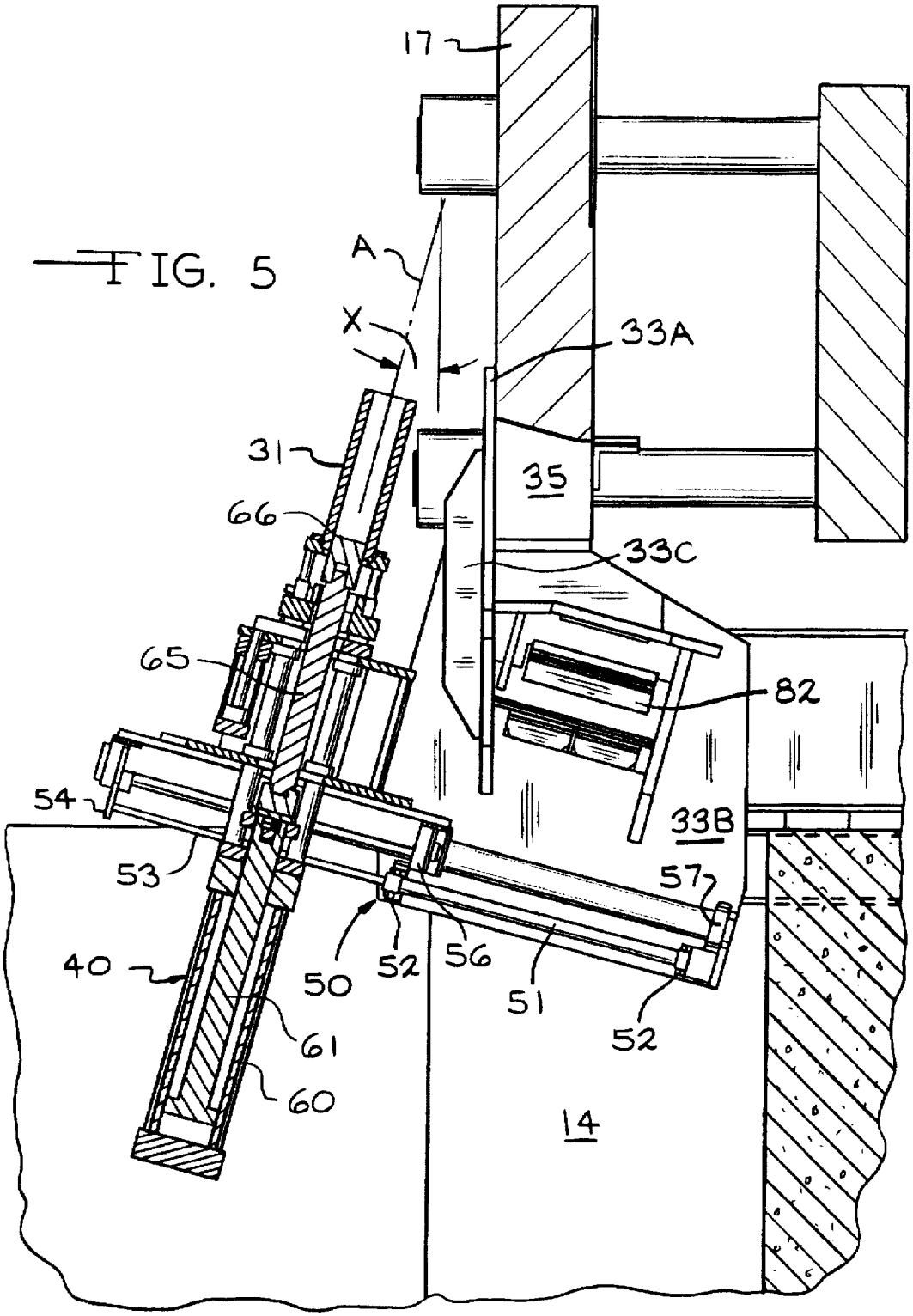
FIG. 5 is an elevational view, partly in section, showing the machine as viewed 90° from that of FIG. 2 and showing the shot sleeve in a position to receive molten metal from a ladle.

The shot assembly 40 includes a carrier assembly 50 which functions to reciprocate the shot sleeve 31 and related mechanism from the metal receiving position shown in FIG. 5 to a position (FIG. 6) ready for movement to the docking position. The carrier assembly 50 is supported for reciprocal movement on a pair of traversing rods 55 by means of bushings 56. Each of the traversing rods 55 is mounted to its respective plate 33B by two support members 57. One such support member 57 is positioned near the end of its respective traversing rod 55 and the other is near the center with the result that the opposing end extends as a cantilever beyond the center support member. Such opposing ends are joined together by a cross plate 59. A pair of cylinders 51 fastened by brackets 52 to the plate 33B have rods 53 fastened to a cross piece 54 of the carrier assembly 50 and provide the power of such reciprocal movement.

Figure 6:
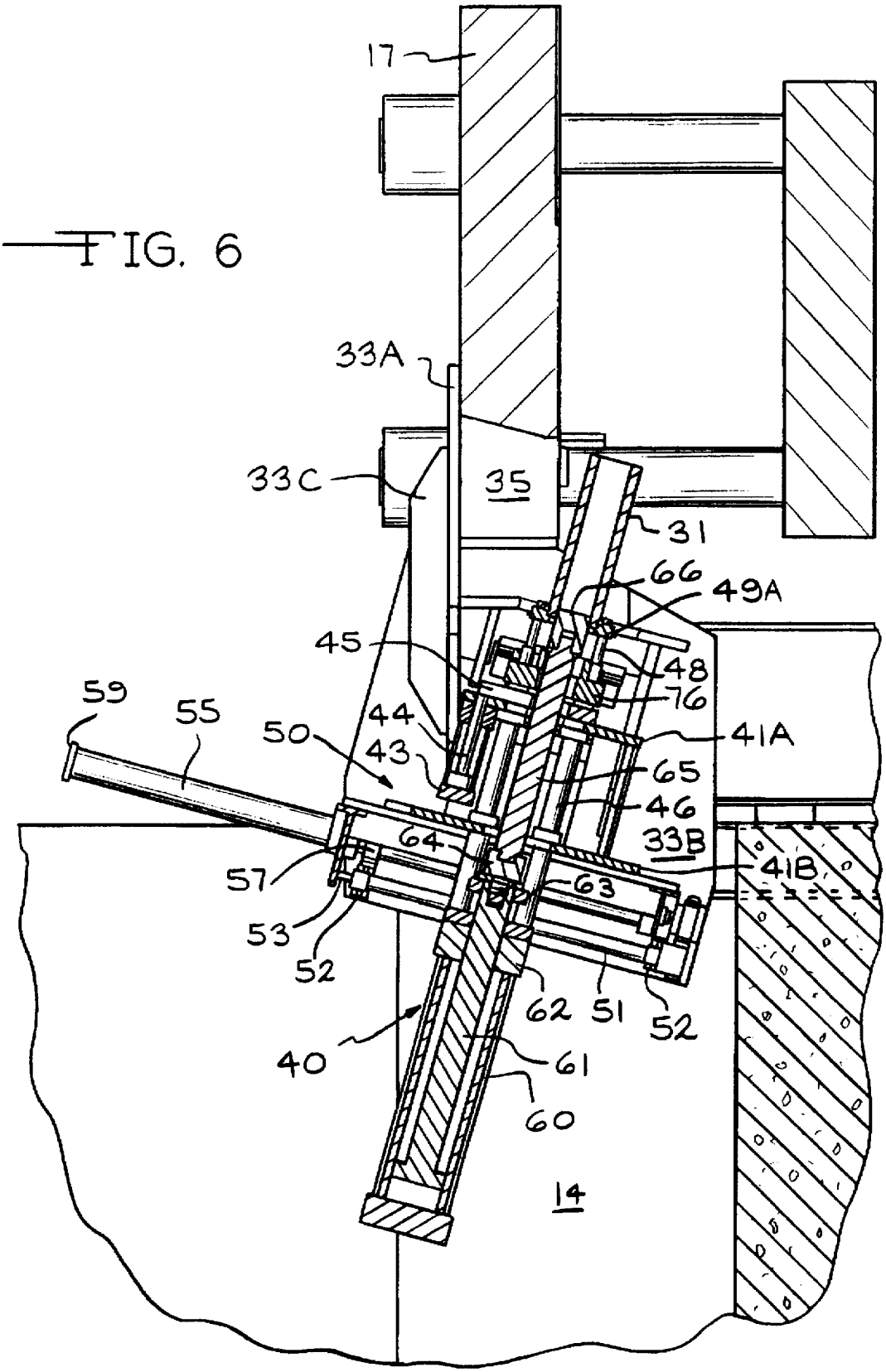
FIG. 6 is a view similar to FIG. 5 showing the relative position of the parts following movement of the shot sleeve and shot cylinder from the molten metal receiving position to a position beneath the molds and ready for movement into the docking position.
Figure 7:
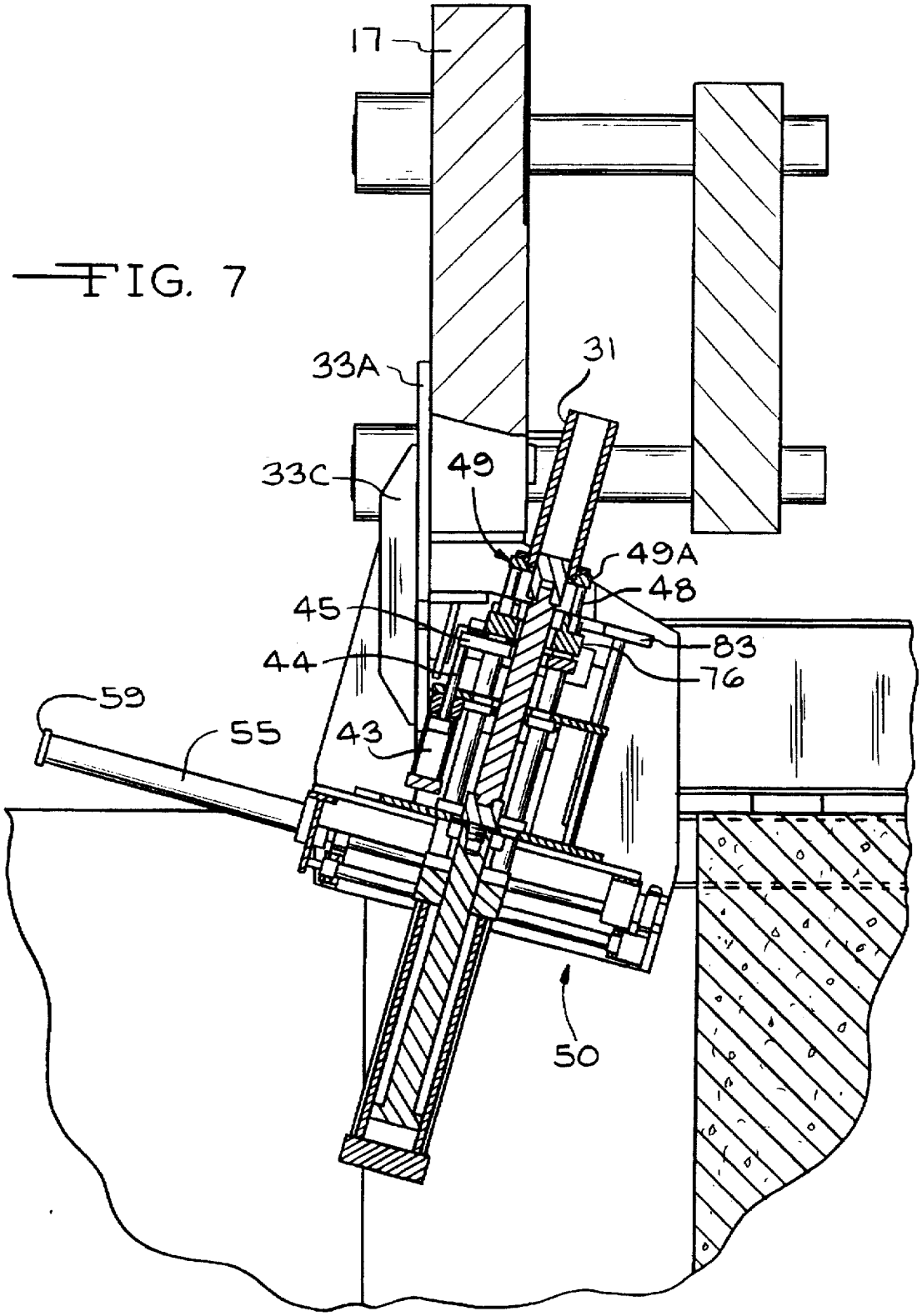
FIG. 7 is a view similar to FIG. 6 showing the relative position of the parts following actuation of the docking cylinders to move the sleeve into the docking position.

As will be appreciated, movement of the carrier assembly 50 from the position of FIG. 6 to the metal receiving position of FIG. 5 carries the shot assembly 40, including the shot sleeve 31 at an upward angle of X° from horizontal. As a result of this, the top of the sleeve 31 is at a higher pour height than is possible with machines utilizing a pivoting sleeve and shot cylinder.

Supported on the carrier assembly 50 is a shot cylinder 60 having a shot cylinder rod 61 mounted on an internal piston and extending out of a cylinder head 62. The shot cylinder 60 extends below the main floor level into a pit 14. Secured to the shot cylinder rod 61 by means of a coupling 64 is a shot arm 65 having a tip 66 which extends into the lower end of the sleeve 31 when the shot cylinder 60 is in the retracted position shown in FIGS. 5 through 10 and may be moved upwardly (FIG. 11) to eject molten aluminum contained in the sleeve 31 upon actuation of the shot cylinder 60. A trail rod bracket 63 is positioned between the shot cylinder rod 61 and the coupling 64.

Mounted on the carrier assembly 50 is a main frame 41. The frame 41 includes upper and lower frame plate members 41A and 41 B, respectively, joined together by connector members 41C. A pair of docking cylinders 43 are mounted on upper frame plate member 41A. The docking cylinders 43 have rods 44 extending through the upper frame plate member 41A and attached to a cross plate 45. Extension of the rods 44 of cylinders 43 moves the cross plate 45 upwardly.

Positioned above and supported on the cross plate 45 is a docking plate 76. Four tie rods 46 are joined at one end to the cylinder head 62 of the shot cylinder 60 and are jointed at their opposing ends to the docking plate 76. Thus, upward or downward movement of the docking plate 76 will carry with it the shot cylinder 60. The tie rods 46 are not attached to upper frame plate 41 A, the lower frame plate 41B or the cross plate 45 but rather extend through bushings 47 attached to the upper frame plate 41A and the lower frame plate 41B. The cross plate 45 is sized and shaped such that none of the tie rods 46 extend therethrough but rather are located outside the periphery of such cross plate 45.

The cross plate 45 functions as the lower member of a sleeve frame 49 which supports the lower end of the sleeve 31. The sleeve frame includes an upper sleeve frame member 49A rigidly secured to the cross plate 45 by dowels 48. The dowels 48 extend through bushings 71 mounted on the docking plate 76. Accordingly, the docking plate 76 is capable of movement without moving the sleeve frame 49. Actuation of the cylinders 43 will initially move the cross plate 45 and the rest of the sleeve frame 49 (i.e. the dowels 48 and upper sleeve frame member 49A) and will carry with it the docking plate 76 resting on the cross plate 45. Stiffeners 45A are welded to the cross plate 45.

Figure 9:
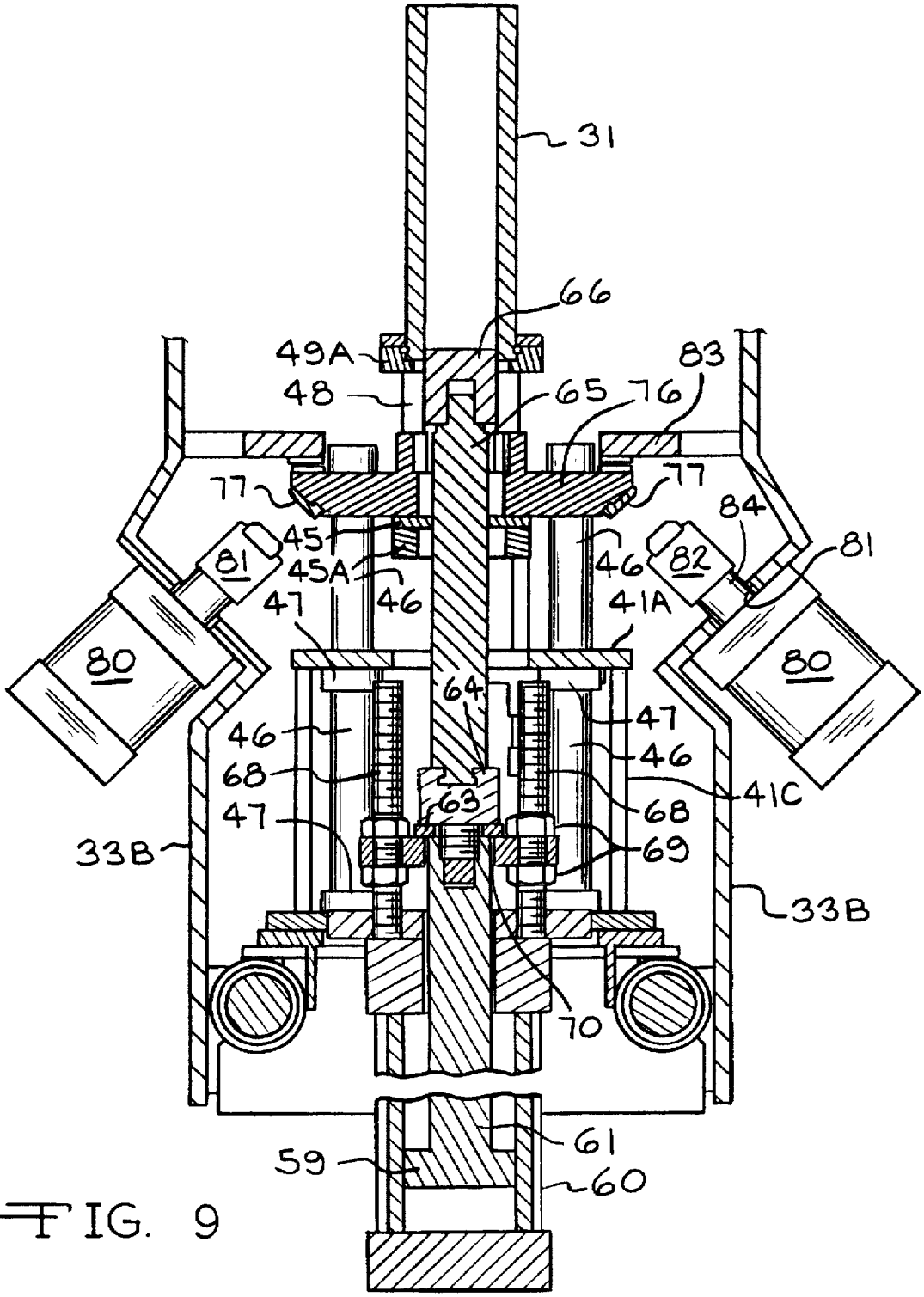
FIG. 9 is a view showing the machine in the operating position of FIG. 7 but as viewed 90° from FIG. 7.
Figure 10:
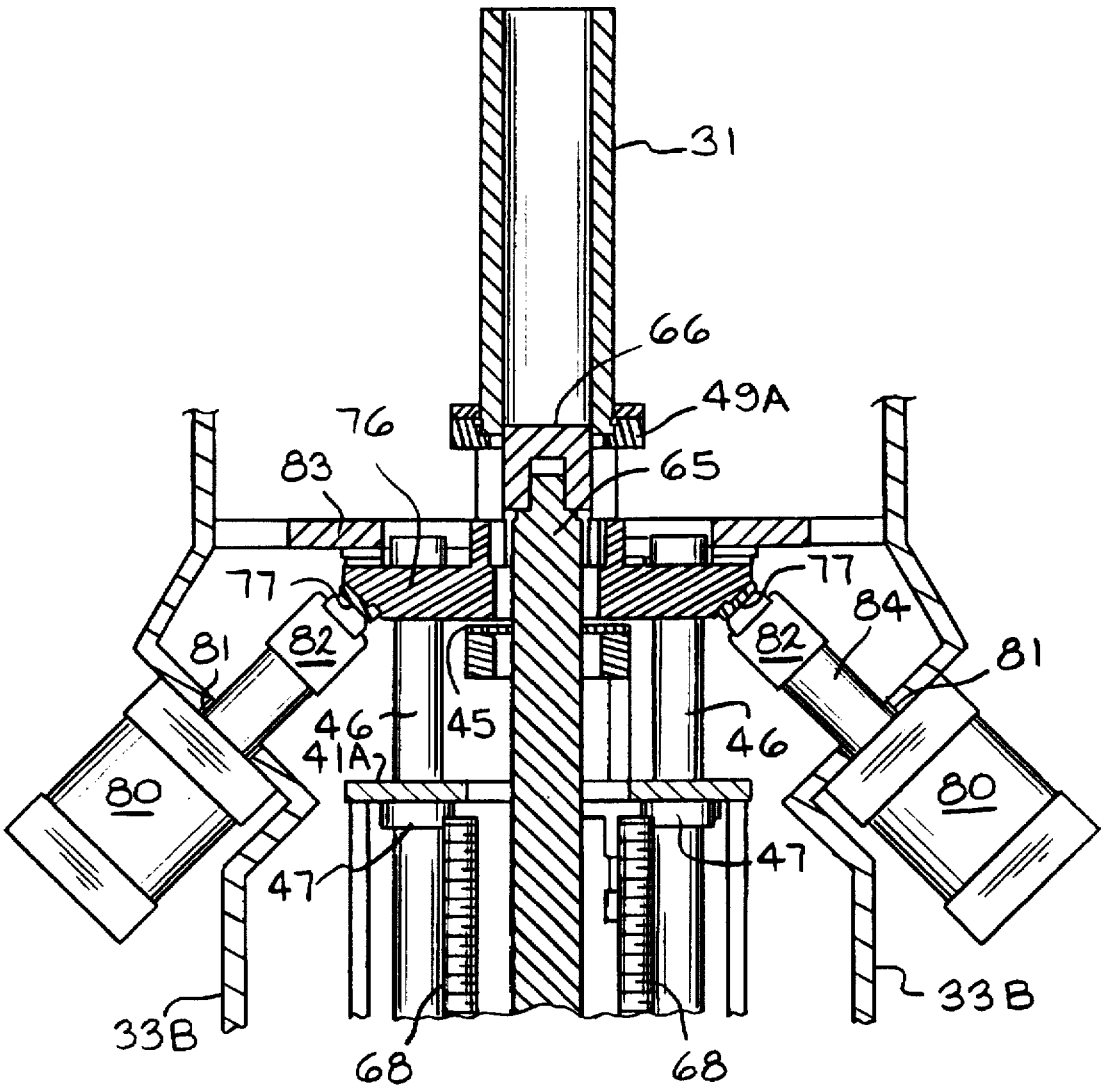
FIG. 10 is a fragmentary view similar to FIG. 9 showing the upper portion of the machine and the relative position of the parts following actuation of the locking cylinders to move the parts into locking position.
Figure 11:
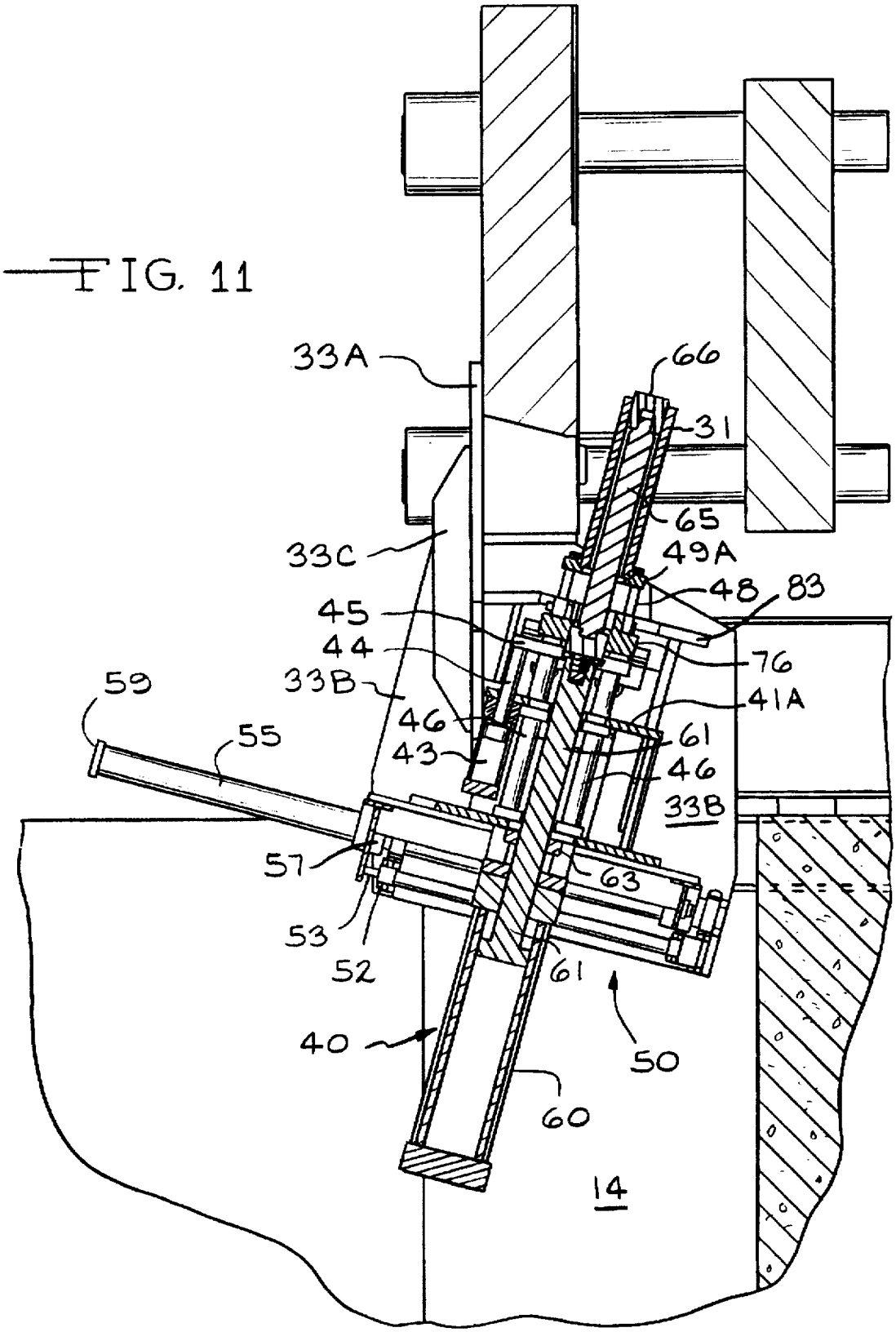
FIG. 11 is a view similar to FIG. 7 showing the parts in the locking position and the sleeve and shot rod following actuation of the shot cylinder to eject molten aluminum from the sleeve and inject it into the closed dies.

The docking plate 76 has tapered lower edges to which are affixed wear pads 77. Movement of the docking plate 76 carried by the cross plate 45 as it is urged upwardly by the cylinders 43 brings the docking plate 76 within a short distance, on the order of one-eighth inch, of its final position (FIG. 9). The docking cylinders 43 are relatively low force cylinders. Movement of the docking plate 76 to its final locking position is provided by four high force locking cylinders 80, two of which are mounted on each plate 33B of the respective structural member 33. Each of the high force locking cylinders 80, are positioned at an angle relative to the docking plate 76 and each has a rod 84 which extends through an opening 81 of its respective plate 33B.

The locking cylinders 80 are provided with locking heads 82 attached to rods 84 extending from each cylinder 80. As can be seen by comparing FIGS. 8 and 9, movement of the docking plate 76 upwardly in response to urging by the lower sleeve frame carried by the cross plate 45 as it is moved by the docking cylinders 43, carries such docking plate 76 from a position below the locking heads 82 (FIG. 8) to a position such that each of the wear pads 77 is aligned with the locking head 82 and the axes of its cylinders 80 so that, upon extension of the rods 84, each locking head 82 will engage a wear pad 77 (See FIG. 10) and urge the docking plate 76 upwardly the final one-eighth inch or so to the locking position. Such final movement of the docking plate 76 does not cause any movement to the sleeve 31 which had previously been sealingly engaged to the docking block 30 by actuation of the docking cylinders 43. The sleeve 31 is then ready for actuation of the shot cylinder 60 to inject molten aluminum in the closed dies 16 and 18. As can be seen by comparing FIGS. 9 and 10, when the docking plate 76 reaches the docking position of FIG. 9, it is slightly spaced from a wear plate of the locking plate 83. The actuation of the locking cylinders 80 urges the docking plate 76 upwardly the short final distance against the locking plate 83.

Following actuation of the locking cylinders 80, the shot cylinder 60 may be actuated to move the piston 59, its rod 61, and the joined shot arm 65 and tip 66 forwardly to eject molten metal from the shot sleeve 31, through the docking block 30 and into the cavity defined by the dies 16 and 18. During such actuation of the shot cylinder 60, it will have the supplementary support of the locking cylinders 80 as it develops the high injection pressure and the opposing resultant forces attempt to urge the shot cylinder 60 away from the dies.

Throughout the entire operation, the shot sleeve 31 and the shot cylinder 60 with the rod 61, and shot arm 65 are maintained at the fixed angle X with respect to vertical. Thus, the movements of the sleeve 31, shot cylinder 60 and related elements of the die casting machine of the present invention are in a straight line motion and not in a circular or rotary motion as in the prior art.

It will be noted that as the carrier assembly 50 shifts from the metal receiving position of FIG. 5 to the position of FIG. 6, the straight line movement is at a downward angle with respect to horizontal which is the same magnitude as the angle X. The shot sleeve 31 moves at such angle from a position outside of the front platen 17, through the cut-out 35 to a position aligned for engagement with the docking block.

Depending upon the size of the part to be cast, varying quantities of molten aluminum will be delivered to the shot sleeve 31 for injection into the closed dies. When a large part is to be cast, the shot sleeve 31 will be filled to its maximum fill height and the shot cylinder rod 61 will be moved through its maximum stroke in the shot cylinder 60 in order to inject the full volume of molten aluminum into the cavity of the closed dies. When a small part is to be cast, the sleeve 31 will be only partially filled with molten aluminum. In order to avoid the necessity of the shot cylinder rod 61 being extended through its maximum stroke when the part being produced is small, thus requiring only a partial filling of the sleeve with molten aluminum, means are provided for adjusting the position of the shot cylinder rod 61 its connected shot arm 65 and tip 66.

Figure 8:
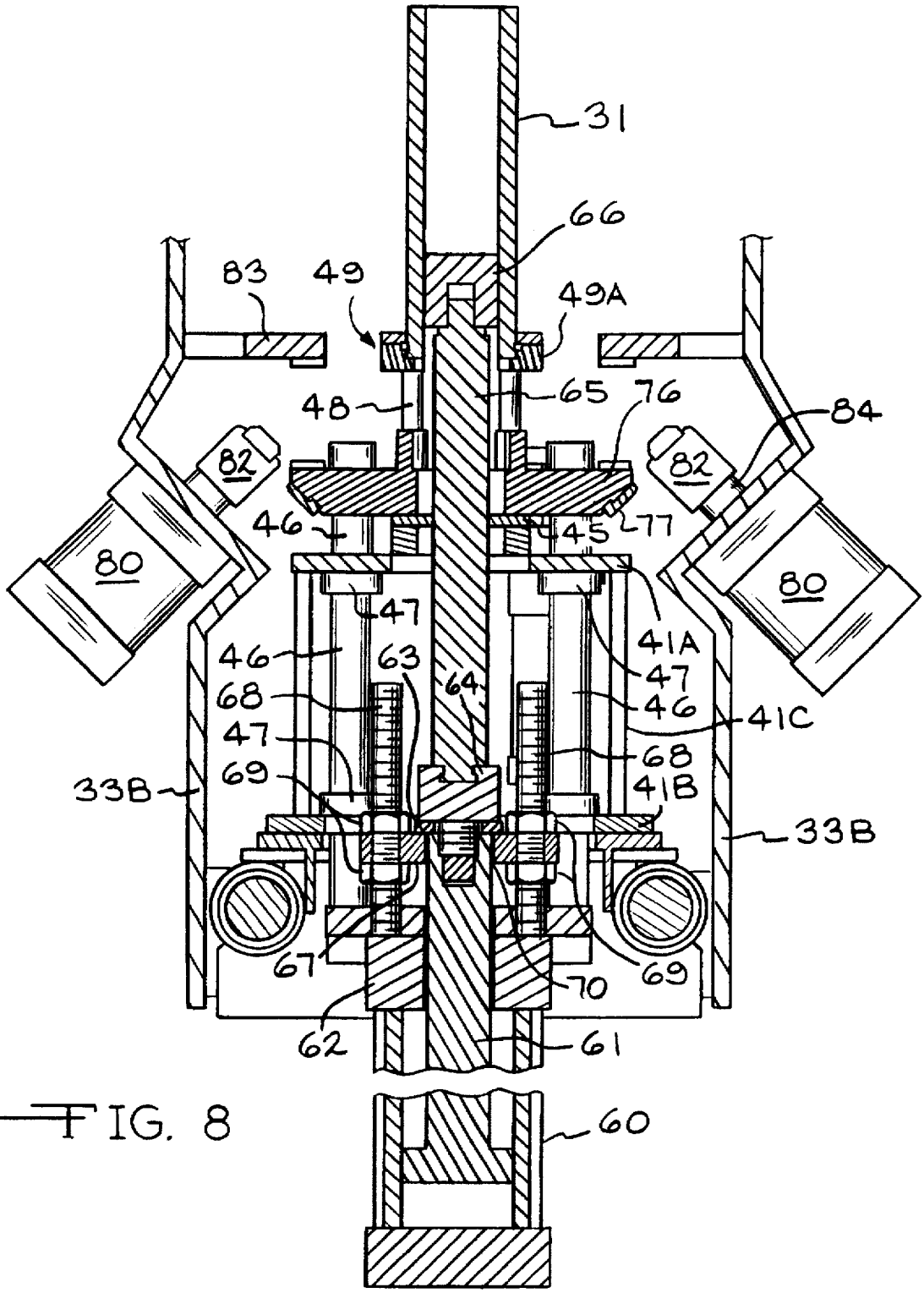
FIG. 8 is a view showing the machine in the operating position of FIG. 6 but as viewed 90° from FIG. 6.

As may be seen in FIG. 8, when the shot cylinder 60 and its shot cylinder rod 61 are in the retracted position, the trail rod bracket 63 is engaged by the shot coupling 64 thereby limiting the extent to which the shot cylinder rod 61 may be retracted. A stop plate 67 is adjustably mounted on a plurality of threaded rods 68 by nuts 69. The threaded rods are supported on the cylinder head 62. The stop plate 67 has an aperture 70 sufficiently large to permit the shot cylinder rod 61 to readily pass therethrough but sufficiently small to prevent the trail rod bracket 63 from moving therethrough. This feature permits the shot cylinder rod 61 and shot arm 65 with its tip 66 to be adjusted axially in the sleeve 31. Thus, if the size of the part being cast were large thereby requiring a shot of molten aluminum of maximum quantity, the stop plate 67 would be adjusted on the threaded rods 68 such that the tip 66 was received in the lower end of the sleeve 31 only a small distance. However, if the part being cast were smaller, the stop plate 67 would be adjusted by the nuts 69 on the threaded rods 68 to move the shot arm 65 and its tip 66 axially upwardly into the sleeve 31 thereby shortening the stroke required of the shot cylinder 60 and its rod 61 in order to inject the molten aluminum into the dies.

Figure 14:
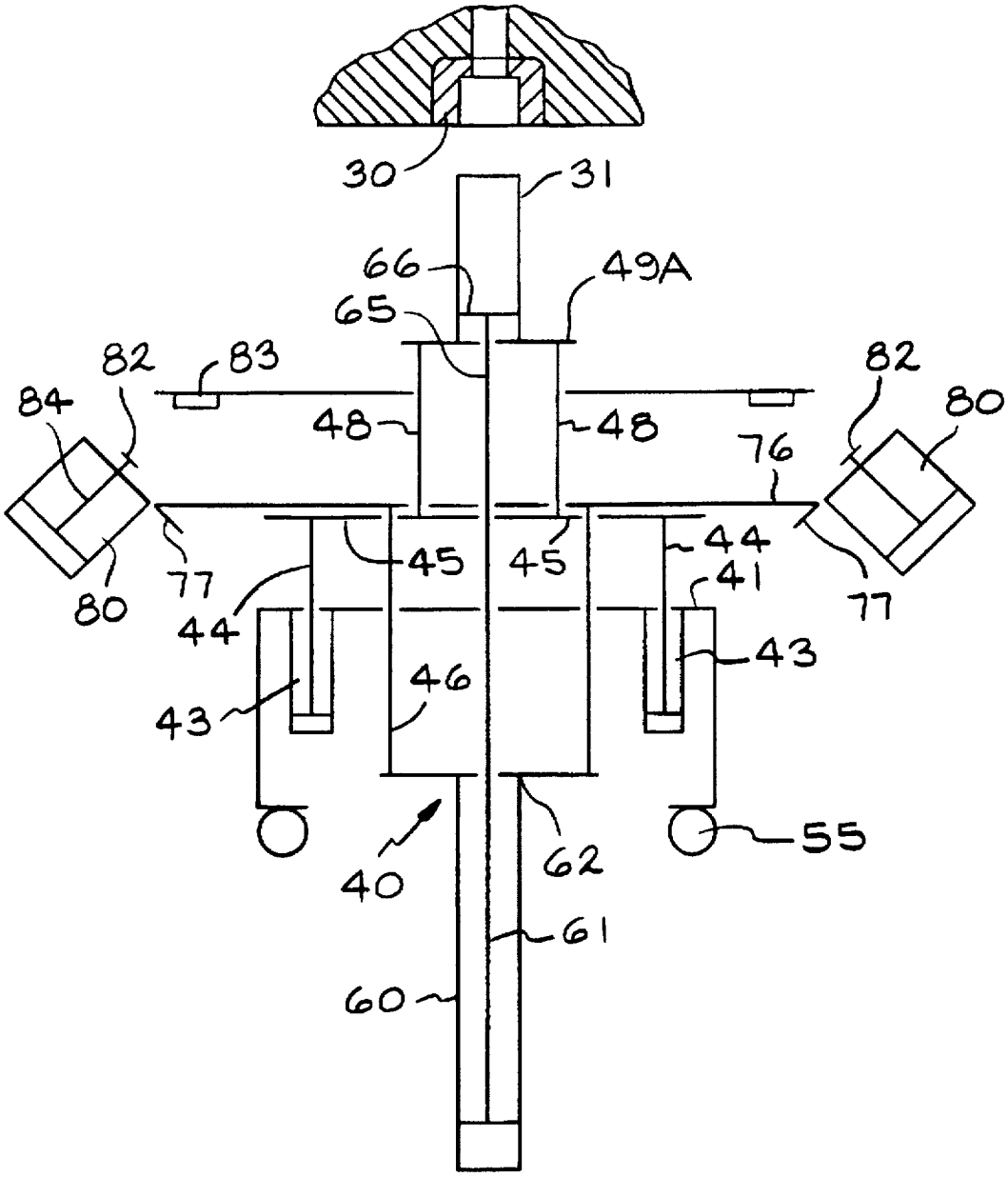
FIGS. 14–16 are schematic line drawings showing the relative positioning of the respective parts as they are moved from the position of FIG. 6 (FIG. 14) to the docking position of FIG. 7 (FIG. 15) and finally to the locking position of FIG. 10 (FIG. 16).
Figure 15:
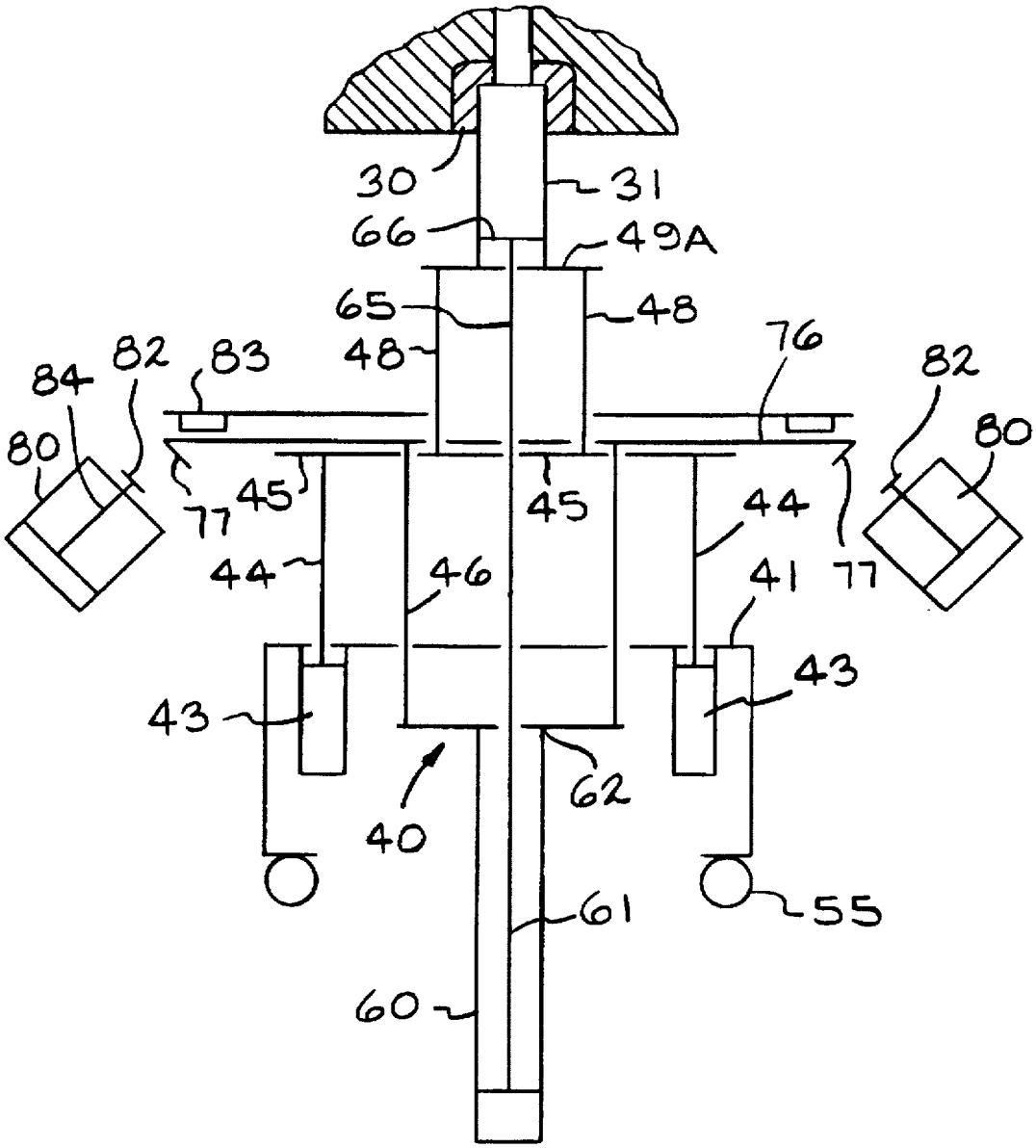
Figure 16:
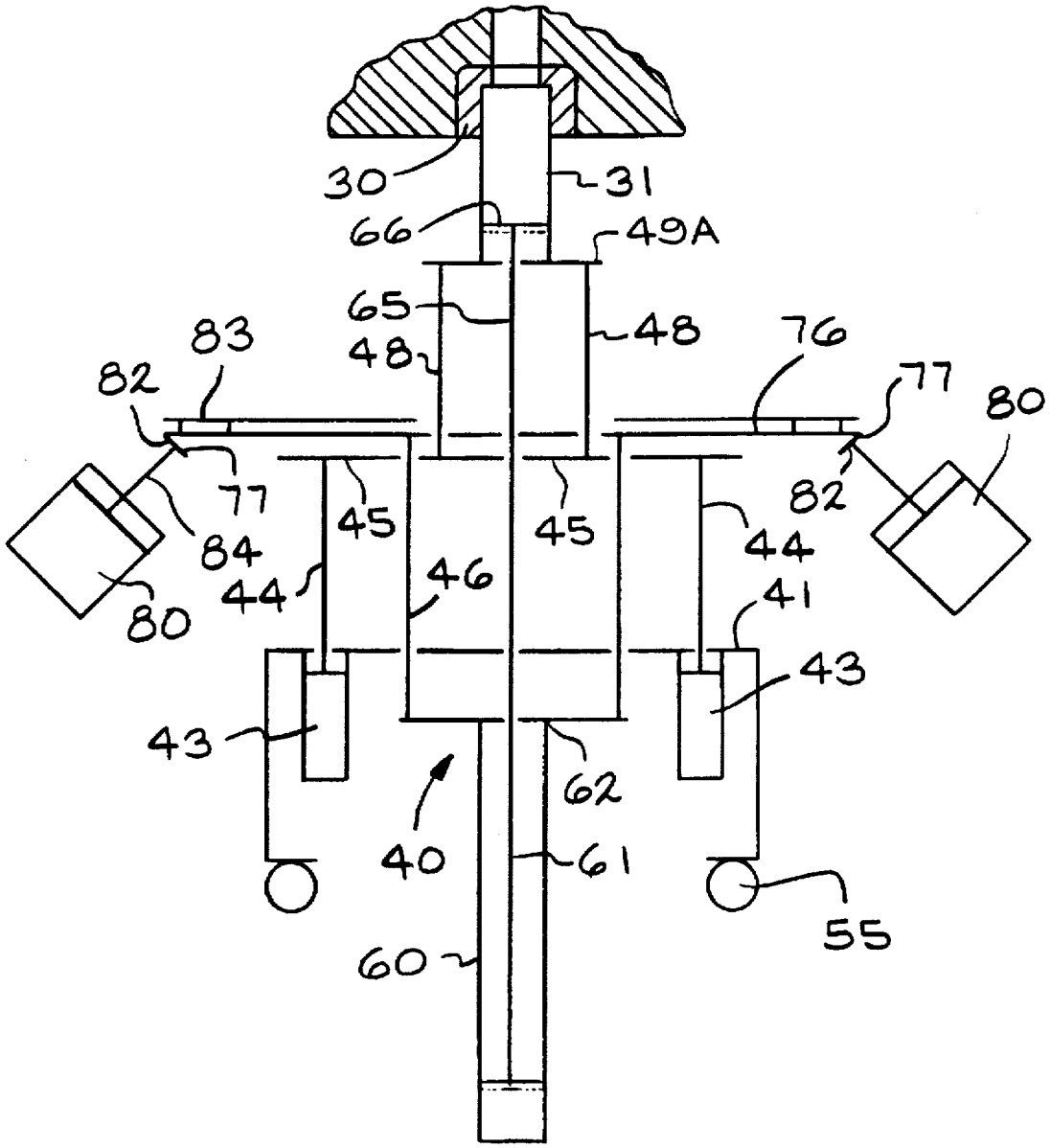

Referring to FIGS. 14–16, there is shown schematically the operation of the shot assembly 40 and the locking cylinders 80 following the shifting of shot assembly 40 on the traversing rods 55 of the carrier assembly 50 from the shot receiving position of FIG. 5 to the position of FIG. 6 aligned for movement to the docking position.

FIG. 14 shows the main frame 41 following its shifting on the traversing rods 55 to carry the shot assembly 40 to the position of FIG. 6 aligned for movement to the docking positions.

As shown in FIG. 14, the docking cylinders 43 are mounted on the main frame 41 with their rods 44 extending upwardly. As previously described, the docking cylinders may be disposed at an angle of X° with respect to vertical. The rods 44 are attached to cross plate 45 which supports the upper sleeve frame 49A by means of upwardly extending dowels 48. The dowels 48 extend through but are not connected to the docking plate 76. The docking plate 76 does, however, rest upon the plate 45. Therefore, upward movement of the plate 45 in response to actuation of the cylinders 43 will move not only the upper sleeve frame 49A and sleeve 31, but also will carry upwardly with it the docking plate 76 to the docking position aligned with the locking cylinders 80 (FIG. 15). Such upward movement of the docking plate 76 also carries with it the shot cylinder 60 attached thereto by the tie rods 46 attached to the cylinder head 62 and the sleeve 31 which becomes sealingly engaged with the docking block 30.

As shown in FIG. 16, actuation of the locking cylinders 80 to extend the rods 84 causes the heads 82 to engage the wear pads 77 and thereby push the docking plate 76 upwardly to the locking position against locking plate 83. The movement of the docking plate 76 upwardly to the locking position as a result of actuation of the locking cylinders 80 effects a "lost motion" relative to the sleeve 31 which is already in a fixed position sealingly engaged to the docking block 30.

The shot cylinder 60 may now be actuated to eject molten aluminum from the sleeve 31 with assurance that the locking cylinders 80 will support the docking plate 76 and the shot cylinder 60 by means of the tie rods 46 from being pushed downwardly in response to the opposing forces generated by ejection of the molten aluminum from the sleeve 31.

The casting machine of the present invention has many advantages over vertical casting machines of the prior art. The design which permits the shot sleeve to be maintained at a fixed angle provides exceptionally reliable and consistent operation particularly when various parts wear. This is in contrast to machines utilizing a pivoting sleeve and shot cylinder in which wearing of the parts requires frequent adjustments to be made. Additionally, the straight line movement of the fixed angle shot assembly of the machine of the present invention results in a machine which is much easier to adjust than those of the prior art.

Furthermore, the mounting of the shot assembly 40 of the machine of the present invention is such as to elevate the shot cylinder 60 itself when the shot sleeve 31 and the rest of the shot assembly 40 are moved to the docking and locking positions. This results in a significant reduction in hydraulic requirements over the prior art machines in which the shot cylinder remain stationary when the sleeve is moved to the docking position.

Finally, the feature of providing an adjustment for the shot cylinder rod 61 and shot arm 65 to permit a shorter stroke when a relatively small part/small shot is utilized, saves hydraulic motion and time required for a cycle of casting such small part over that which would be required in casting the same part with the shot cylinder utilizing its full stroke.

Many modifications will be readily apparent to those skilled in the art. For example, although the machine has been described with the sleeve disposed at an angle of 10° or more with respect to vertical, the sleeve and shot cylinder could be disposed at an angle of less than 10° with respect to vertical and could be disposed with their axes in a vertical position. However, if the dies are provided with a bottom slide such as the bottom slide 20, it is much preferred that the sleeve and shot cylinder be disposed at an angle of at least 10° with respect to vertical. Accordingly, the scope of the present invention should be limited only by the scope of the claims appended hereto. Although the invention has been described in connection with the die casting of aluminum, the machine described and claimed herein may be used for die casting other metals.

I claim:

1. A method for casting metals comprising the steps of:

(a) providing a die defining a cavity, an aperture communicating with said cavity and a sleeve for receiving metal in a molten condition, said sleeve having a tip positioned for longitudinal movement therein from a retracted position to an extended position;

(b) disposing said sleeve at a fixed angle relative to vertical;

(c) moving said sleeve along a first straight line path from a first position remote from said die aperture to an intermediate position aligned with said aperture and thereafter along a second path from said intermediate position to an engagement position communicating with said aperture while maintaining the sleeve at said angle;

(d) placing molten metal into said sleeve when said sleeve is in said first position and said tip is in said retracted position; and (e) moving said tip to said extended position while said sleeve is in said engagement position to inject the molten metal into said cavity.

2. A method for casting metals according to claim 1, wherein said sleeve extends along an axis and said first straight line path is at an angle normal to said axis.

3. A method for casting metals according to claim 1, wherein said sleeve is disposed at an angle of at least 10° relative to vertical.

4. A method for casting metals according to claim 1, further including the step of adjusting the extent to which said tip extends into said sleeve prior to placing the molten metal in said sleeve.

5. A method for casting metals according to claim 1, wherein said sleeve has an upper end for receiving said metal and wherein said upper end is at an elevated position higher than that of said aperture when said sleeve is in said first position.

6. A method for casting metals according to claim 2, further including the steps of providing a die defining a cavity, an aperture communication with said cavity, a sleeve for receiving metal in a molten condition, a shot cylinder and rod, and a tip on said rod, shifting said sleeve, said shot cylinder and said rod to a position at which said sleeve is aligned with said aperture such that straight line movement of said sleeve upwardly at said fixed angle will cause said sleeve to engage said aperture and extending said shot rod to cause said tip to eject said molten metal from said sleeve.

7. A method of die casting molten metal in a die by injection through an aperture in said die comprising the steps of:

(a) providing a sleeve, a shot cylinder and rod, shot arm and tip supported on said cylinder rod, said tip extending into said sleeve, a support for said shot cylinder, docking cylinders and locking cylinders;

(b) actuating said docking cylinders to lift said shot cylinder, rod, shot arm, tip and sleeve thereby bringing said sleeve into engagement with said die aperture;

(c) thereafter actuating said locking cylinders to move said shot cylinder while maintaining said sleeve in engagement with said die aperture;

(d) placing molten metal in the sleeve; and (e) injecting said molten metal through said aperture.

8. A method of die casting molten metal according to claim 7, wherein said sleeve is maintained at a fixed angle with respect to vertical throughout steps (a), (b) and (c) and further including the step of extending said shot rod to eject said molten metal from said sleeve and into said die while continuing to maintain said angle.

9. A method of die casting molten metal according to claim 7, wherein said sleeve is maintained at an angle of at least 10° with respect to vertical throughout steps (a), (b) and (c) and further including the step of extending said shot rod to eject said molten metal from said sleeve and into said die while continuing to maintain said angle.

10. A method of die casting molten metal according to claim 7, further including placing said molten metal into said sleeve while said sleeve is disposed at an angle of at least 10° with respect to vertical and out of alignment with said aperture and, while maintaining said sleeve at said angle, (i) shifting said sleeve, said shot cylinder and said rod to a position at which said sleeve is aligned with said aperture such that straight line movement of said sleeve upwardly at said angle will cause said sleeve to engage said aperture and (ii), extending said shot rod to cause said tip to eject said molten metal from said sleeve.

11. A method of die casting molten metal according to claim 7, further including the steps of adjusting the position of said shot cylinder rod in said shot cylinder to thereby adjust the extent to which said tip extends into said sleeve and thereafter delivering said molten metal to said sleeve prior to the step of actuating said docking cylinders.

12. A method of die casting molten metal in a die by injection of said molten through an aperture in said die comprising the steps of:

(a) providing (i) a first movable support, a sleeve mounted for movement with said first movable support, said sleeve having an upper end for receiving said molten metal, first power means for moving said first movable support in a generally upward direction, (ii) a second movable support above said first movable support positioned to be carried thereby upon movement of said first movable support in said generally upward direction, said second movable support being mounted for movement independent of said first movable support, second power means for moving said second movable support, (iii) a shot cylinder having a rod extending therefrom, a shot arm and tip extending from said rod and into said sleeve, said shot cylinder mounted for movement with said second movable support, (b) actuating said first power means to move said sleeve into communication with said die aperture and said second movable support into position to be engaged by said second power means, (c) thereafter actuating said second power means to move said second moveable support, (d) placing molten metal in the sleeve; and (e) injecting said molten metal through said aperture.

13. A method of die casting molten metal according to claim 12, wherein said sleeve is maintained at a fixed angle with respect to vertical throughout steps (a), (b) and (c) and further including the step of extending said shot rod to eject said molten metal from said sleeve and into said die while continuing to maintain said angle.

14. A method of die casting molten metal according to claim 12, wherein said sleeve is maintained at an angle of at least 10° with respect to vertical throughout steps (a), (b) and (c) and further including the step of extending said shot rod to eject said molten metal from said sleeve and into said die while continuing to maintain said angle.

15. A method of die casting molten metal according to claim 12, further including placing said molten metal into said sleeve while said sleeve is disposed at an angle of at least 10° with respect to vertical and out of alignment with said aperture and, while maintaining said sleeve at said angle, (i) shifting said first movable support, said second movable support and said shot cylinder to a position at which said sleeve is aligned with said aperture such that straight line movement of said sleeve upwardly at said angle will cause said sleeve to communicate with said aperture, and (ii) extending said shot rod to cause said tip to eject molten metal from said sleeve and inject it into said die.

16. A method of die casting molten metal according to claim 12, further including the steps of adjusting the position of said shot cylinder rod in said shot cylinder to thereby adjust the extent to which said tip extends into said sleeve and thereafter delivering said molten metal to said sleeve.

17. A method of die casting comprising the steps of:

(a) positioning a shot assembly with a sleeve containing molten metal in a position aligned with a docking block of a die, said shot assembly including (i) docking cylinders having attached for movement therewith a movable plate and a means for supporting said sleeve for movement with said movable plate, (ii) a docking plate positioned between said movable plate and said sleeve, (iii) a shot cylinder attached to said docking plate for movement therewith, said shot cylinder including a shot rod extensible to move a tip positioned in said sleeve, (b) moving said movable plate and said sleeve upwardly to engage said sleeve with said docking block, at least a portion of the movement of said movable plate carrying said docking plate therewith, (c) engaging said docking plate with locking cylinders mounted independently of said shot assembly to urge said docking plate further upwardly to locking position while said sleeve remains in fixed engagement with said docking block, and (d) ejecting said molten metal from said sleeve and into said die.

18. A method of die casting molten metal according to claim 17, wherein said sleeve is maintained at a fixed angle with respect to vertical throughout steps (a), (b) and (c) and further including the step extending said shot rod to eject said molten metal from said sleeve and into said die while continuing to maintain said angle.

19. A method of die casting molten metal according to claim 17, wherein said sleeve is maintained at an angle of at least 10° with respect to vertical throughout steps (a), (b) and (c) and further including the step extending said shot rod to eject said molten metal from said sleeve and into said die while continuing to maintain said angle.

20. A method of die casting molten metal according to claim 17, further including the steps of placing said molten metal into said sleeve while said sleeve is disposed at an angle of at least 10° with respect to vertical and out of alignment with said docking block and, while maintaining said sleeve at said angle, (i) shifting said movable plate, sleeve, docking plate and shot cylinder to a position at which said sleeve is aligned with said docking block such that straight line movement of said sleeve upwardly at said angle will cause said sleeve to engage said docking block and (ii), extending said shot rod to cause said tip to eject said molten metal from said sleeve and inject it into said die.

21. A method of die casting molten metal according to claim 17, further including the step of adjusting the position of said shot cylinder rod in said shot cylinder to thereby adjust the extent to which said tip extends into said sleeve prior to step (a).

22. A method of die casting molten metal according to claim 18, further including the step of adjusting the position of said shot cylinder rod in said shot cylinder to thereby adjust the extent to which said tip extends into said sleeve prior to step (a).

23. In a machine for die casting molten metal in a die through an aperture, said machine including, (a) a first movable support, (b) a sleeve mounted for movement with said first movable support, said sleeve having an upper end for receiving said molten metal, (c) a first power means for moving said first movable support in a generally upward direction, (d) a second movable support above said first movable support positioned to be carried thereby upon movement of said first movable support in said generally upward direction, said second movable support being mounted for movement independent of said first movable support, (e) a second power means for moving said second movable support, and (f) a shot cylinder having a rod extending therefrom, a shot arm and tip extending from said rod and into said sleeve, said shot cylinder mounted for movement with said second movable support, actuation of said first power means moving said first movable support to carry said sleeve into communication with said die.

24. A machine for die casting molten metal according to claim 23, further including a carriage assembly supporting (i) said first movable support such that said sleeve is disposed in a fixed angle relative to vertical and (ii) said second movable support such that said shot cylinder, said rod and said shot arm are disposed at said fixed angle.

25. A machine for die casting molten metal according to claim 24, further including fixed support bars for supporting said carriage assembly and a third power means for moving said carriage assembly on said fixed support bars from a molten metal receiving position at which said sleeve is misaligned with said aperture to a position at which said sleeve is aligned with said aperture.

26. A machine for die casting molten metal according to claim 25, wherein said fixed support bars are disposed at an angle of 90° with respect to said sleeve angle.

27. A machine for die casting molten metal according to claim 24, wherein said fixed angle is at least 10°.

28. A machine for die casting molten metal according to claim 23, further including an adjustment member supporting one of said shot cylinder rod or said shot arm, said adjustment member adjustable to vary the position of said shot cylinder rod in said shot cylinder.

29. In a die casting machine for casting molten metal through an aperture in dies, said machine including (a) a shot assembly having (i) a sleeve, (ii) a shot cylinder, a rod extending therefrom and a shot arm attached to said rod for movement therewith, said shot arm having a tip extending into said sleeve, (iii) a primary support structure, (iv) docking cylinders having rods mounted to said primary support structure extending generally upwardly therefrom, (v) a secondary support structure connected to said docking cylinder rods for movement therewith, (vi) connectors joining said secondary support structure to said sleeve, (vii) a docking plate positioned above said secondary support structure in position to be moved upwardly upon contact and urging thereby, (viii) means mounting said docking plate for movement independently of movement of said secondary support structure, (ix) fasteners joining said shot cylinder to said docking plate for movement therewith, and (b) locking cylinders fixedly mounted and having engagement heads;

said docking cylinders actuatable to urge said secondary support structure and said sleeve generally upwardly, said secondary support structure carrying said docking plate to a position aligned for engagement by said engagement heads upon actuation of said locking cylinders.

30. A die casting machine for casting molten metal according to claim 29, further including adjustment rods for adjusting the position of said rod in said shot cylinder.

31. A die casting machine for casting molten metal according to claim 29, further including a carriage assembly for moving said shot assembly from a first position misaligned with said die aperture for receiving molten metal in said sleeve to a second position at which said sleeve is aligned with said aperture, said carriage maintaining said sleeve and said shot arm at a fixed angle relative to vertical throughout movement form said misaligned position to said aligned position.

32. A die casting machine according to claim 31, wherein said fixed angle is at least 10°.

33. A die casting machine for casting molten metal according to claim 32, wherein said carriage assembly includes cylinders and support rods for moving said shot assembly at an angle of at least 10° relative to horizontal during movement of said shot assembly from said misaligned position to said aligned position.

34. A die casting machine for casting molten metal according to claim 33, wherein a portion of said sleeve is positioned at a higher elevation than said aperture when in said misaligned position.

35. A die casting machine comprising (a) dies defining a cavity for receiving molten metal, said dies being relatively movable between an open position and a closed position, aperture means in said dies for receiving molten metal injected upwardly therethrough, said aperture means communicating with said cavity, (b) a shot assembly for receiving molten metal at a first station and delivering said molten metal to said dies at a second station, said shot assembly including (i) a sleeve having an open upper end and being disposed in a fixed angle with respect to vertical and (ii) a shot cylinder having a rod, an extension movable by said rod for ejecting molten metal from said sleeve open upper end, (c) support and docking means for said shot assembly including:

(i) a main support member, (ii) docking cylinder means mounted on said main support member and having rods extending upwardly therefrom at said angle, (iii) a docking plate above said support member, (iv) a cross plate between said main support member and said docking plate said docking cylinder rods engaged to said cross plate, (v) a sleeve support frame supporting said sleeve for movement therewith, a portion of said sleeve support frame being positioned above said docking plate and said sleeve support frame mounted for movement with said cross plate and for movement independently of said docking plate, said sleeve being engageable with said aperture upon actuation of said docking cylinder means, and (vi) tie rods joining said docking plate to said shot cylinder; and (d) stationary locking cylinders positioned to be engageable with said docking plate following actuation of said docking cylinder means and movement of said shot assembly and said support and docking means, including said docking plate.

36. The die casting machine of claim 35, further including means for shifting said shot assembly and said support and docking means from a first shot receiving position wherein said sleeve open upper end is remote from said dies to a second position aligned to move said sleeve along a path at said angle to engage said aperture means.

37. The die casting machine according to claim 36, wherein said means for shifting includes a carriage assembly, cylinders having a movable member affixed to said carriage assembly and a fixed member affixed to a fixed support member.

38. The die casting machine according to claim 37, wherein said locking cylinders are mounted on said fixed support member.

39. The die casting machine according to claim 35, wherein said fixed angle is at least 10°.

40. The die casting machine according to claim 35, further including adjustment rods extending from said shot cylinder in fixed relationship thereto, a support plate mounted on said adjustment rods for positioning in variably spaced relationship with said shot cylinder, said support plate having an aperture, at least one of said rod and said extension extending through said aperture and having an abutment affixed thereto, said abutment larger than said aperture and supported on said support plate.

41. Apparatus for injecting molten metal into closed dies comprising (a) a sleeve having an open upper end for receiving molten metal, (b) a shot assembly including a shot cylinder having a shot rod extending generally upwardly therefrom and a shot tip mounted for movement therewith positioned in said sleeve, (c) a first support member, (d) docking cylinders mounted on said first support member, said docking cylinders having rods extending therefrom in a generally upwardly direction for movement, respectively, between a retracted position and an extended position, (e) a second support member mounted on said rods for movement therewith, (f) a third support member positioned above said second support member and connected for movement with said second support member, said sleeve mounted for movement with said third support member, (g) a docking plate positioned between said second support member and said third support member, said docking plate supported separately from said second support member for movement independently therefrom but positioned to be moved upwardly by said second support member upon upward of said second support member, (h) tie rods joining said shot cylinder to said docking plate for movement therewith, and (i) fixed locking cylinders having heads engageable with said docking plate when said docking plate has been urged upwardly by said second support member in response to extension of said docking cylinder rods.

* * * * *

UNITED STATES PATENT AND TRADEMARK OFFICE

CERTIFICATE OF CORRECTION

PATENT NO. : 5,701,944
DATED : December 30, 1997
INVENTOR(S) : Robert W. Young

It is certified that error appears in the above-identified patent and that said Letters Patent is hereby corrected as shown below:

Col. 8, line 42, delete "2" and insert --1--.

Col. 8, line 44, delete "communication" and insert --communicating--.

Signed and Sealed this

Twelfth Day of May, 1998

Bruce Lehman

*Attest:*

BRUCE LEHMAN

*Attesting Officer*

*Commissioner of Patents and Trademarks*